US006846191B2

(12) United States Patent
Hobbs et al.

(10) Patent No.: US 6,846,191 B2
(45) Date of Patent: Jan. 25, 2005

(54) ELECTRICAL CONNECTOR ASSEMBLY

(75) Inventors: Jon C. Hobbs, Burghill, OH (US); John R. Morello, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 23 days.

(21) Appl. No.: 10/351,183

(22) Filed: Jan. 24, 2003

(65) Prior Publication Data

US 2004/0147158 A1 Jul. 29, 2004

(51) Int. Cl.[7] ..... H01R 13/62
(52) U.S. Cl. ..... 439/157; 439/140
(58) Field of Search ..... 439/140, 141, 439/157, 374, 378, 372

(56) References Cited

U.S. PATENT DOCUMENTS 5,035,633 A * 7/1991 Kobayashi et al. ..... 439/140
5,222,907 A * 6/1993 Katabuchi et al. ..... 439/377
5,437,558 A * 8/1995 Sakuraoka et al. ..... 439/140
5,879,174 A * 3/1999 Kountz et al. ..... 439/141
6,086,385 A 7/2000 Wang et al.
6,095,840 A * 8/2000 Yamaguchi et al. ..... 439/247
6,142,813 A 11/2000 Cummings et al.
6,162,085 A 12/2000 Chugh et al.
6,171,146 B1 1/2001 Fink et al.
6,179,658 B1 1/2001 Gunay et al.
6,203,364 B1 3/2001 Chupak et al.
6,208,233 B1 3/2001 Stein, Sr. et al.
6,247,951 B1 6/2001 Di Liello et al.
6,247,965 B1 6/2001 Cummings et al.
6,305,957 B1 10/2001 Fink et al.
6,338,651 B1 1/2002 Svette, Jr. et al.
6,345,706 B1 2/2002 Oliver et al.
6,390,834 B1 * 5/2002 Hofmeister et al. ..... 439/140
6,406,307 B2 6/2002 Bungo et al.
6,422,881 B1 * 7/2002 Puhl et al. ..... 439/140
6,443,137 B1 9/2002 Kraft et al.
6,454,060 B1 9/2002 Lisenker et al.
6,494,751 B1 12/2002 Morello et al.
6,508,666 B1 1/2003 Francis
6,533,588 B1 3/2003 Woith et al.
6,533,611 B2 3/2003 Morello et al.
6,535,396 B1 3/2003 Degenkolb et al.
6,556,118 B1 4/2003 Skinner
6,565,372 B2 5/2003 Bakker et al.
6,578,444 B1 6/2003 Wendelin

* cited by examiner

*Primary Examiner*—Hien Vu
(74) *Attorney, Agent, or Firm*—David P. Wood

(57) ABSTRACT

An electrical connector assembly has a male connector which mates to a female connector thereby electrically engaging male terminal blades, locked to a male connector body, to female terminals locked to a female connector body. The blade of each male terminal project into a blind bore defined by a shroud of the male connector body. Prior to mating of the electrical connector assembly, a retractable terminal blade stabilizer is snap fitted into a blade alignment position with the male connector via a dual fastening feature constructed and arranged between the male connector body and the stabilizer, which prevents withdrawal of the stabilizer from the male connector and restricts further insertion of the stabilizer into the blind bore. When the stabilizer is in the blade alignment position, the tips of the blades are disposed within respective apertures of the stabilizer and aligned to their respective female terminals and the remaining portion of the blades are shielded and thus protected from possible damage. During mating of the electrical connector assembly, the female connector body is press fitted to an axial projecting member of the stabilizer, prior to the stabilizer moving out of the alignment position.

8 Claims, 3 Drawing Sheets

ELECTRICAL CONNECTOR ASSEMBLY

TECHNICAL FIELD

The present invention relates to an electrical connector assembly, and more particularly to an electrical connector assembly having a retractable terminal blade stabilizer.

BACKGROUND OF THE INVENTION

Electrical connector assemblies are know to have a male connector which mates to a female connector thereby electrically engaging respective male terminal blades to female terminals. The blade of each male terminal may extend axially into a blind bore defined by an axially projecting shroud of the male connector body. Prior to mating of the electrical connector assembly, a conventional self-aligning blade stabilizer is known to be snap fitted into a blade alignment position within the blind bore of the male connector via a dual locking feature which prevents withdrawal of the stabilizer from the male connector and restricts further insertion of the stabilizer into the blind bore from the blade alignment position and toward a fully seated position. When the stabilizer is in the blade alignment position, the tips of the blades are disposed within respective apertures of the stabilizer and are thus pre-aligned to respective mating female terminals. Moreover, when the stabilizer is in the alignment position the terminal blades are protected from being inadvertently knocked and bent which could cause blade misalignment preventing connector assembly mating or hindering electrical continuity of the mated assembly. Furthermore, the stabilizer prevents entry of debris into the blind bore of the male connector which could obstruct the mating of the electrical connector assembly. During mating of the electrical connector assembly, the stabilizer is pushed out of the blade alignment position and into the seated position as the blades travel through the apertures and into the female terminals of the female connector.

Unfortunately, when the mated electrical connector assembly is un-mated, the stabilizer remains in the seated position and does not automatically return or retract to its original alignment position. Thus, the stabilizer is not reuseable and does not protect the terminal blades of an un-mated electrical connector assembly which was once mated.

SUMMARY OF THE INVENTION

An electrical connector assembly has a male connector which mates to a female connector thereby electrically engaging male terminal blades, locked to a male connector body, to female terminals locked to a female connector body. The blade of each male terminal project into a blind bore defined by a shroud of the male connector body. Prior to mating of the electrical connector assembly, a retractable terminal blade stabilizer is snap fitted into a blade alignment position with the male connector via a dual fastening feature constructed and arranged between the male connector body and the stabilizer, which prevents withdrawal of the stabilizer from the male connector and restricts further insertion of the stabilizer into the blind bore. When the stabilizer is in the blade alignment position, the tips of the blades are disposed within respective apertures of the stabilizer and aligned to their respective female terminals and the remaining portion of the blades are shielded and thus protected from possible damage. During mating of the electrical connector assembly, the female connector body is press fitted to an axial projecting member of the stabilizer, prior to the stabilizer moving out of the alignment position. Once the stabilizer is fitted to the female connector, continued mating causes the stabilizer to move out of the alignment position and into a seated position as the blades travel through the apertures and into the female terminals of the female connector. When the electrical connector assembly is being unmated, the female connector being tightly fitted to the stabilizer pulls the stabilizer out from the seated position and back into the blade alignment position. Because the engagement of the stabilizer to male connector in the blade alignment position is stronger than the tight fit of the stabilizer to the female connector, continued un-mating of the female connector disengages the stabilizer from the female connector leaving the stabilizer in the blade alignment position as the female connector is completely separated from the male connector. The stabilizer is thus retracted and placed back into a position for protecting and maintaining alignment of the terminal blades of the male connector.

Preferably, the rigid member projects axially from a base plate of the stabilizer and toward the female connector. Preferably, two rounded tabs project laterally outward from the member to resiliently engage the female connector body within a cavity carried by the body. The tight fit between the tabs of the member and the female connector is strong enough to pull the stabilizer from the fully seated position to the pre-stage position when the electrical connector assembly is being unmated. However, this tight fit is not strong enough to force the stabilizer out of the pre-staged position in such a fashion that the stabilizer becomes completely removed from the blind bore of the male connector.

An advantage of the present invention is a robust and low cost stabilizer which is automatically retractable and thus is repeatably reusable during the mating and un-mating process of the electrical connector assembly. Another advantage of the present invention is the prevention of accidental mis-alignment or bending of the protruding blades of the male terminals of an electrical connector assembly being re-mated. Yet another advantage of the present invention is the elimination of foreign article or debris collection within the blind bore of the male connector which could prevent fill re-mating of the electrical connector.

BRIEF DESCRIPTION OF THE DRAWINGS

The presently preferred embodiments of the invention are disclosed in the following description and in the accompanied drawings, wherein.

DETAILED DESCRIPTION OF THE PREFERRED EMBODIMENTS

Figure 1:
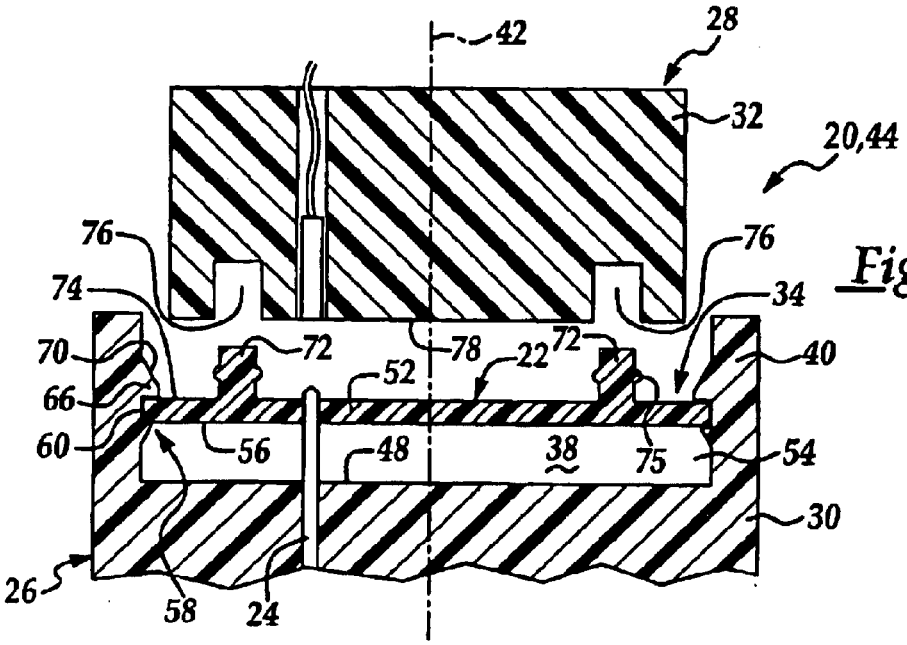
FIG. 1 is a partial cross section of an electrical connector assembly of the present invention illustrating the assembly in an un-mated position and the stabilizer in a blade alignment position.
Figure 2:
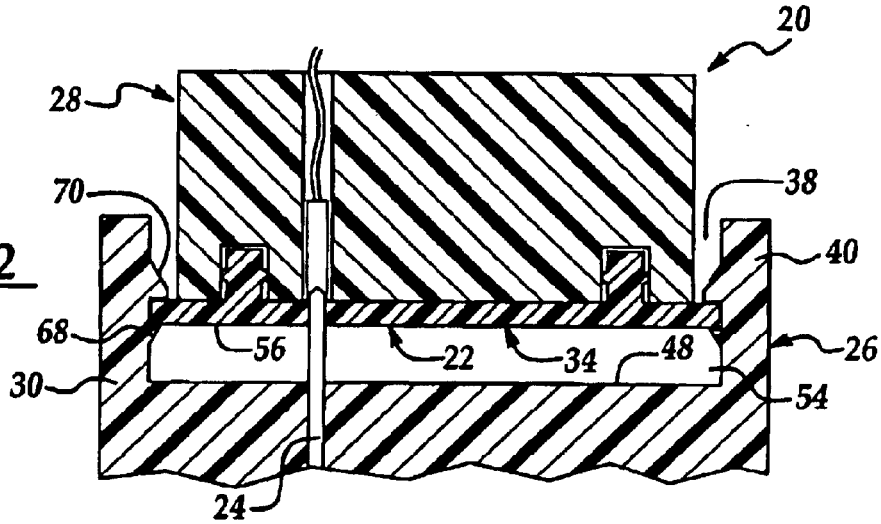
FIG. 2 is a partial cross section of the electrical connector assembly wherein a female connector of the assembly is engaged to the stabilizer in the blade alignment position.
Figure 3:
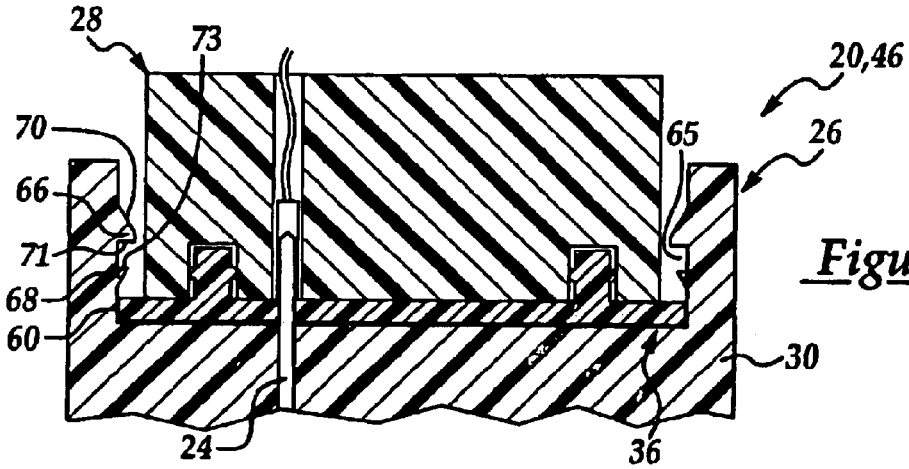
FIG. 3 is a partial cross section of the electrical connector assembly illustrated in a mated position with the stabilizer in a seated position.

Referring now to the drawings, FIGS. 1–3 illustrate a multi-pin electrical connector assembly 20 having a self-aligning, dual-positioning, pin or blade stabilizer 22 for ensuring a reliable and a repeatably mateable electrical connection. The blade stabilizer of the assembly protects a series of terminal blades 24 of a male connector 26 prior to mating of the male terminals or blades 24 to a series of non-ferrous contacts or female terminals of a female connector 28. In addition, because the male terminals 24 are locked to a male connector body 30 and are known to rock or laterally move slightly with respect to the body, the blade stabilizer 22 acts to pre-align distal tips of the male terminal blades for mating to the female terminals (not shown) of the female connector 28. The stabilizer 22 is generally disposed between the plastic body 30 of the male connector 26 and a plastic body 32 of the female connector 28 which carries the female terminals.

Unlike conventional blade stabilizers, the plastic blade stabilizer 22 of the present invention is reuseable and thus automatically retracts, or pulls partially away from the male connector 26 when the connector assembly 20 is un-mated. When the connector assembly 20 is being mated, the blade stabilizer 22 moves from a blade alignment position 34 which pre-aligns and protects the blades 24, as best shown in FIGS. 1 and 2, to a fully seated position 36, as best shown in FIG. 3. When the connector assembly 20 is being unmated, the blade stabilizer retracts from the fully seated position 36 and back to the alignment position 34.

In both positions 34, 36, the stabilizer 22 is disposed within a blind bore or alcove 38 defined by a forward projecting circumferential housing or shroud 40 of the male connector body 26. During the mating process and with the stabilizer 22 in the alignment position 34, the female connector 28 moves along a mating axis 42 into the blind bore 38 from a fully un-mated position 44 wherein the female connector 28 is completely detached from the stabilizer 22 and the male connector 26 (as best shown in FIG. 1). Continued insertion of the female connector 28 causes the body 32 of the female connector to releasably engage the stabilizer 22 as the stabilizer remains in the alignment position 34 (as best shown in FIG. 2). With additional insertion force and with the stabilizer 22 engaged to the female connector body 32, the stabilizer 22 releases from the alignment position 34 and moves toward the fully seated position 36 as the female connector 28 pushes against the stabilizer 22 to achieve a mated position 46, as best shown in FIG. 3. When the connector assembly 20 is fully mated, the stabilizer 22 is in the fully seated position 36 and remains engaged resiliently to the female connector body 32.

During the un-mating process of the electrical connector assembly 20, the positive engagement of the stabilizer 22 to the female connector 28 causes the stabilizer 22 to retract and move with the female connector 28 out of the seated position 36 and back into the alignment position 34. Because the engagement force holding the stabilizer 22 to the female connector body 32 is weaker than the force necessary to completely separate the stabilizer 22 from the male connector body 30, the stabilizer 22 remains in the alignment position 34 as the female connector 28 completely withdraws from both the stabilizer 22 and the 20 male connector 26. Although the engagement force holding the stabilizer 22 to the female connector body 32 is weaker than the force necessary to separate the stabilizer 22 from the male connector body 30, it is stronger than frictional forces between the stabilizer 22 and the male connector 26 which would resist movement of the stabilizer 22 from the seated position 36 and back into the alignment position 34.

Referring to FIGS. 1–4, the male terminal or terminal blades 24 project axially forward from a leading face 48 of the body 30, which defines the bottom of the blind bore 38, and through respective apertures 50 of a base plate 52 of the stabilizer 22 disposed substantially perpendicular to the mating axis 42. When the stabilizer 22 is in the blade alignment position 34, only the distal ends or tips of the blades 24 extend through the apertures 50. The remaining portion of the blades 24 are protected within a void 54 of the blind bore 38 defined axially between a leading surface 56 of the base plate 52 and the leading face 48 of the male connector body 30. The base plate 52 of the stabilizer 22, in combination with the shroud 40, prevents the blades 24 from being knocked or bent prior to mating and prevents debris from entering the void 54 which could obstruct proper mating of the electrical connector assembly 20. Also, when the stabilizer is in the alignment position 34, any pivoting action of the male terminal 24 with respect to the male connector body 30 which could lead to mis-alignment of the blades 24 with respect to the female terminals of the female connector 28 is also prevented. Each aperture 50 has a beveled peripheral edge carried by the leading surface 56 to help guide the distal ends of the pins 24 into the respective aperture 50.

Figure 4:
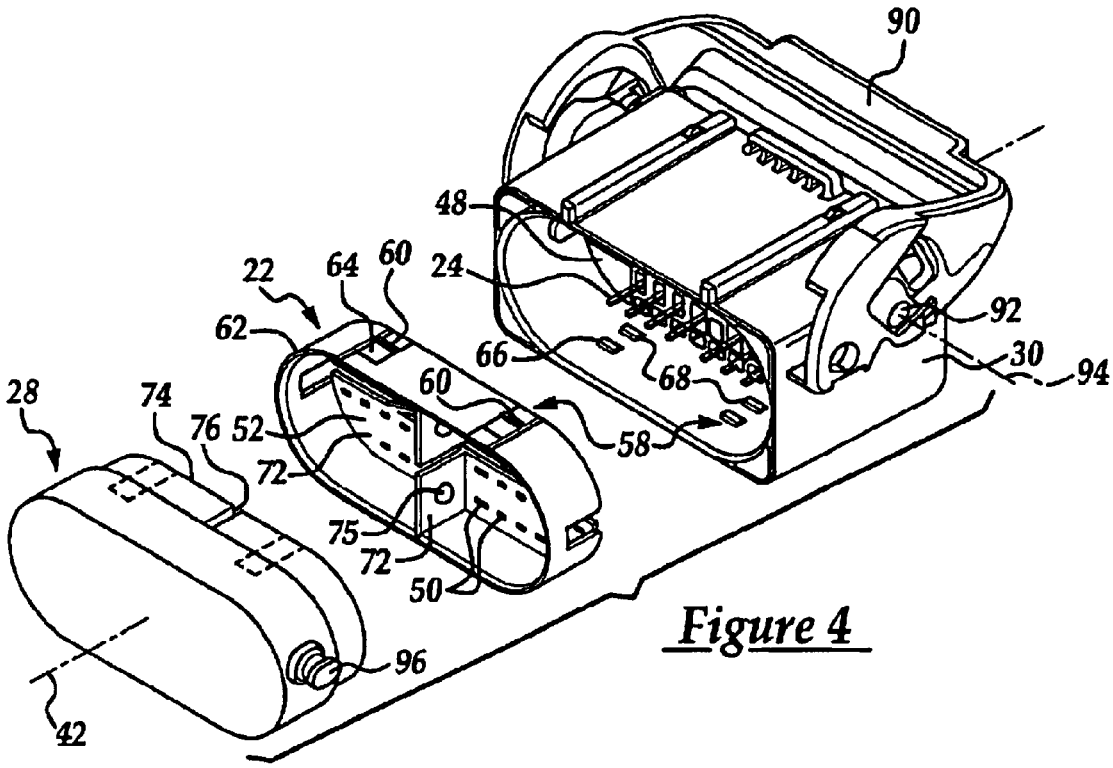
FIG. 4 is an exploded perspective view of the electrical connector assembly.

Referring to FIG. 4, a dual fastening feature 58 constructed and arranged between the stabilizer 22 and the male body 30 secures the stabilizer in, and releases the stabilizer from, the blade alignment position 34. The fastening feature 58 is described in U.S. patent application Ser. No. 10/159,174, filed May 31, 2002, which is a continuation-in-part of U.S. Pat. No. 6,422,881, issued Jul. 23, 2002, both being incorporated herein by reference. Included with the dual fastening feature 58 are four peripheral edges or elongated protuberances 60 which project radially outward from a tubular or peripheral wall 62 of the stabilizer 22 which projects rearward from, and surrounds the periphery of, the base plate 52. The protuberances 60 are spaced circumferentially from one another, and each protuberance 60 is elongated circumferentially with respect to the peripheral wall 62 and projects laterally outward from a slight depression area 64 carried by the wall 62 which extends axially. Each protuberance 60 interacts with a respective recess 65 defined axially between forward lock nub 66 and rearward stage nub 68 which project laterally or radially inward from the shroud 40 of the male body 30, as best shown in FIG. 3.

During assembly, when the stabilizer 22 is being placed in the blade alignment position 34, the protuberance 60 resiliently engages a forward facing ramped face 70 carried by the lock nub 66 and slides thereon until the protuberance 60 snap fits axially over and settles just rearward of the lock nub 66 and directly adjacent to a stop face 71 of the lock nub 66 disposed substantially perpendicular to the shroud 40 of the male body 30. Therefore, the wall 62 must flex substantially radially inward and then snap radially outward to place the protuberance 60 between the lock and stage nubs 66, 68 thus placing the stabilizer 22 in the blade alignment position 34. Preventing the stabilizer 22 from moving further into the blind bore 38 is a stop face 73 carried by the stage nub 68. The stop faces 71, 73 axially define the recess 65 of the dual fastening feature 58 which is carried by the shroud 40.

With the stabilizer 22 engaged to the male connector 26 in the blade alignment position 34, as best shown in FIG. 1, mating of the electrical connector assembly 20 may be done at leisure without worry of debris entry into the blade environment or void 54 of the male connector 26 or bending and misalignment of the terminals 24 which could prevent or degrade electrical continuity of the connector assembly 20.

After the stabilizer 22 is placed in the blade alignment position 34, and during the mating process of the connectors 26, 28, a rigid member 72 which projects rearward from a trailing surface 74 of the base plate 52 inserts into a receiving cavity 76 carried by the female body 32. The member 72 has two rounded tabs 75 which project laterally outward in opposite directions and resiliently bear upon the inner walls of the cavity creating a controlled and slight press fit of the member 72 to the female body 32. Preferably, there are two symmetrically spaced members 72. Each member continues to insert further into respective cavities 76 until a leading surface 78 of the female connector body 32, through which the female terminals are exposed, contacts the trailing surface 74 of the base plate 52 of the stabilizer 22.

With continued mating, the female connector 28 pushes directly upon the stabilizer 22 and snaps the protuberances 60 past the stage nub 68 as the stabilizer moves from the alignment position 34 and toward the seated position 36. As the stabilizer enters further into the blind bore 38, the blades 24 extend further through the apertures 50 to electrically contact the female terminals of the female connector 28. When the stabilizer 22 is in the fully seated position 36, the blades 24 are fully extended through the apertures 50, the void 54 is eliminated, and the leading surface 56 is in contact with the leading face 48 of the male connector body 30. The axial mating force necessary to press fit the member 72 into the cavity 76 is less than the force necessary to snap fit the stabilizer 22 pass the stage nub 68 of the male connector body 30. This assures the tips of the blades 24 are properly aligned to the female terminals prior to the stabilizer 22 moving out of the blade alignment position 34.

The two-stage fastening feature 58 does not directly act upon the stabilizer 22 when in the seat position 36. Instead, the stabilizer 22 is held in the seated position 36 via the adjacent proximity of the male and female bodies 30, 32 alone. Because there is no resilient lock feature holding the stabilizer directly to the male body 30 when the stabilizer is in the seated position 36, the stabilizer 22 remains secured to the female body 32 during un-mating via the engagement of the stabilizer members 72 within the respective cavities 76 of the female body 32. This resilient engagement is strong enough to overcome the interference of the stage nubs 68, thus the female body 32 pulls the stabilizer axially outward and over the stage nubs 68 until the stabilizer snap locks back into the blade alignment position 34. However, the resilient engagement between the female body 32 and the stabilizer 22 is not strong enough to overcome the obstruction or interference of the stop face 71 of the lock nubs 66, hence, continued withdrawal of the female connector 28 from the male connector 26 will cause the members 72 of the stabilizer 22 to release from the female body 32. When the electrical connector assembly 20 is un-mated, the stabilizer is thus retracted and returned to the alignment position 34.

Figure 5:
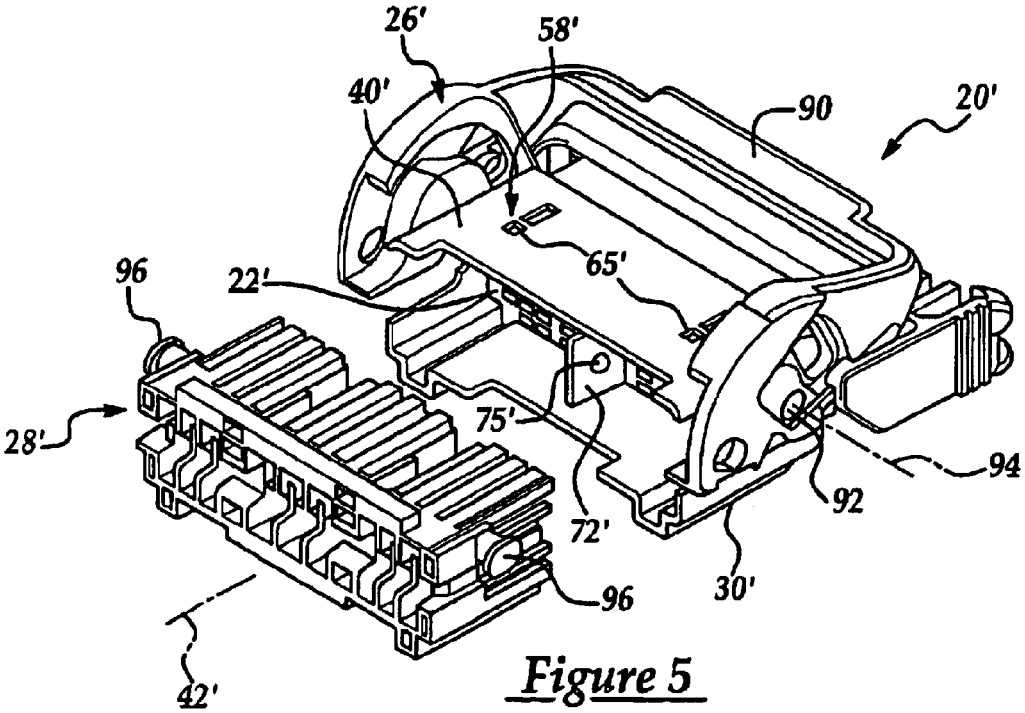
FIG. 5 is a perspective view of a second embodiment of an unmated electrical connector assembly.
Figure 6:
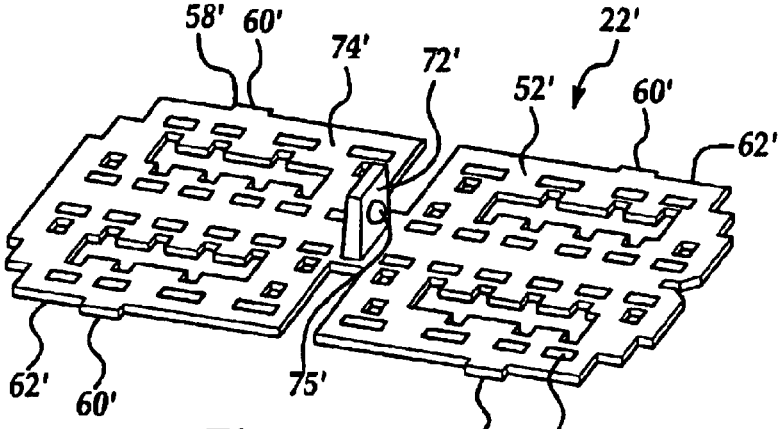
FIG. 6 is a perspective view of a stabilizer of the electrical connector assembly of FIG. 5.

Referring to FIGS. 5 and 6, a modification or second embodiment of the electrical connector assembly 20' is illustrated having a dual fastening feature 58' with a retractable stabilizer 22'. The stabilizer 22' does not have the peripheral wall 62 of the first embodiment, but instead, has a peripheral edge 62' of a base plate 52' of the stabilizer 22'. Integrated into the peripheral edge 62' are four protuberances 60' which project radially outward and into respective recesses 65' carried by a shroud 40' of the male body 30' when the stabilizer is in a blade alignment position (not shown). The recess 65' communicates laterally through the shroud 40' and is defined axially by opposing stop faces 71', 73'. Similarly to the first embodiment, the stabilizer 22' has a rigid member 72' projecting axially outward from a trailing surface 74' of the base plate 52' and is slightly press fitted into a receiving cavity (not shown) of the female body 32' for purposes of stabilizer retraction during un-mating of the assembly 20'. The reference Puhl et al., U.S. Pat. No. 6,422,881, filed Feb. 27, 2001 describes the dual fastening feature 58' in further detail, and is incorporated herein by reference.

Figure 7:
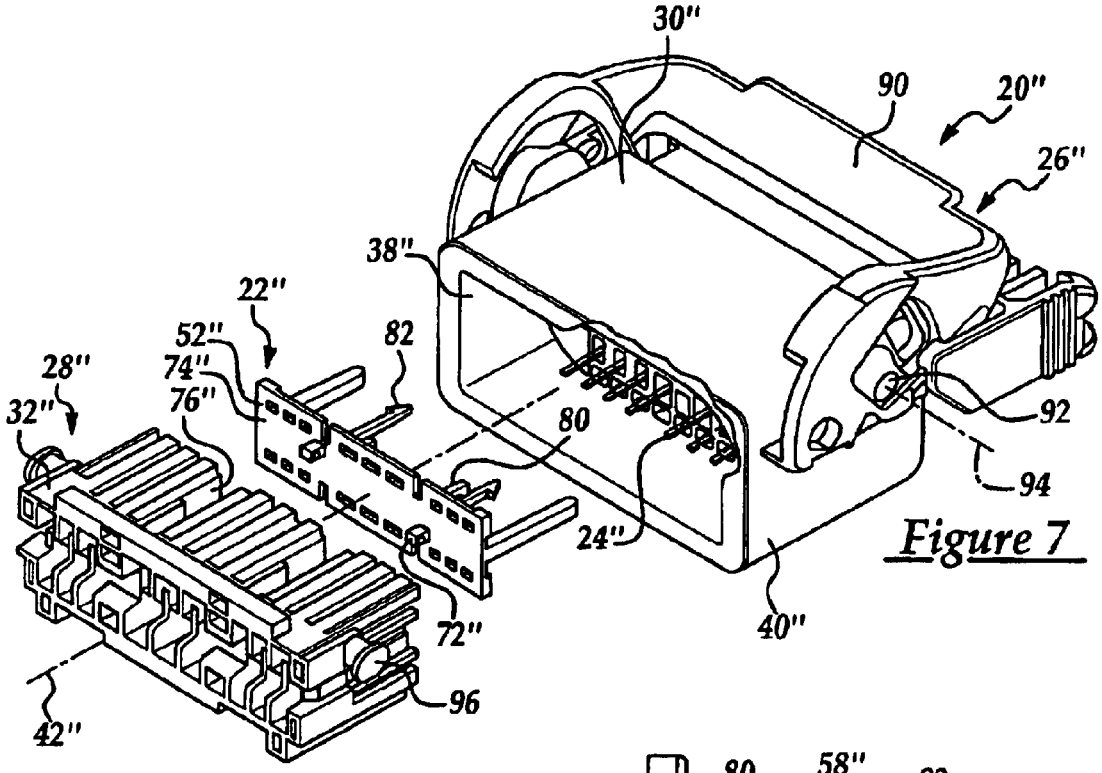
FIG. 7 is an exploded perspective view of a third embodiment of an electrical connector assembly.
Figure 8:
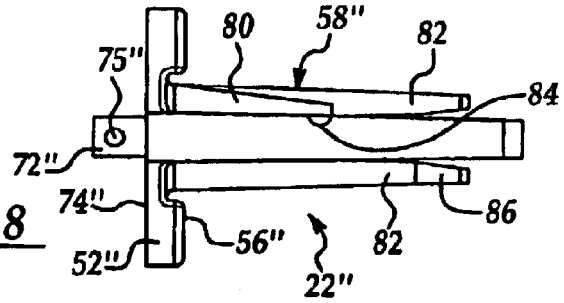
FIG. 8 is a side view of a stabilizer of the electrical connector assembly of FIG. 7.

Referring to FIGS. 7 and 8, a third embodiment of an electrical connector assembly 20" is illustrated wherein a dual fastening feature 58" of the assembly 20" does not have the recesses 65, 65' of the first and second embodiments carried by the respective shrouds 40, 40'. More specifically, the protrusions 60, 60' of the first and second embodiments are replaced with at least one flex arm 80 and at least one lock arm 82, which both project axially from a leading surface 56" of the base plate 52" of the stabilizer 22". The flex arm 80 has an enlarged distal head 84 which engages a shelf (not shown) carried by the male body 30" and disposed within an axially extending hole of the male body 30" to resist movement of the stabilizer 22" from the alignment position to the seated position. Likewise, the lock arm 82 projects axially into a channel of the male body 30" (not shown) wherein a catch head 86 of the lock arm 82 engages a trailing stop face of the male body 30" to prevent the stabilizer 22" from being pulled out of the male connector 26" after the stabilizer 22" snap locks into the blade alignment position 34". The dual fastening feature 58" is described in further detail within U.S. patent application Ser. No. 09/795,692, filed Feb. 27, 2001 which is a continuation-in-part of U.S. patent application Ser. No. 10/159,174, filed May 31, 2002, both being incorporated herein by reference.

Like the first two embodiments, the stabilizer 22" of the third embodiment also has a rigid number 72" projecting axially outward from a trailing surface 74" of the base plate 52" and is slightly press fitted into a receiving cavity 76" of the female body 32' for purposes of stabilizer retraction during un-mating of the assembly 20".

Referring to FIGS. 4, 5 and 7, any of the embodiment illustrated can include a cam lever 90 engaged pivotally to a pair of opposite posts 92 which lie along a pivoting axis 94, disposed perpendicular to the mating axis 42. A pair of cam followers 96 project laterally outward from the female connector body 32. The followers 96 interact with the cam lever 90 so that pivoting of the lever 90 causes the female connector 28 to move toward the male connector 26 along the mating axis 42. This cam lever feature is further described in U.S. Pat. No. 5,810,640, issued Sep. 22, 1998 and is incorporated herein by reference.

While the forms of the invention herein described constitute presently preferred embodiments, many others are possible. It is not limited herein to mention all the possible equivalent forms or ramifications of the invention. It is understood that the terms used herein are merely descriptive rather than limiting and that various changes may be made without departing from the spirit or scope of the invention.

What is claimed is:

1. An electrical connector assembly comprising:

a mating axis;

a male connector having a body with a leading face and a male terminal blade projecting axially along the mating axis and a female connector having a leading surface and a female terminal exposed through the leading surface and engaged electrically to the male terminal when the connector assembly is in a mated position;

a stabilizer having a base plate and a member projecting axially along the mating axis from the base plate toward and spaced from the leading surface of the female connector when the connector assembly is in an un-mated position, the base plate being disposed in the male connector and in between the leading face of the male connector and the leading surface of the female connector;

a fastening feature constructed and arranged between the body of the male connector and the stabilizer for securing the stabilizer in a blade alignment position when the connector assembly is in the unmated position and for releasing the stabilizer from the blade alignment position as the stabilizer moves axially into a seated position and the connector assembly moves into the mated position;

wherein the member is engaged into the female connector when the leading surface is in contact with the base plate of the stabilizer;

wherein the member is press fitted in the female connector when the leading surface is in contact with the base plate of the stabilizer; and wherein the member has a rounded tab projecting radially with respect to the mating axis and the tab is enraged resiliently to the female connector.

2. The electrical connector assembly set forth in claim 1 wherein the body of the male connector has a blind bore defined by an axially projecting shroud and the male terminal blades and the stabilizer are disposed within the blind bore when the stabilizer is in the blade alignment position and when the stabilizer is in the seated position.

3. The electrical connector assembly set forth in claim 2 wherein the fastening feature has a recess carried by the shroud and defined axially by two opposing stop faces of the shroud and the stabilizer is disposed between the stop faces when in the blade alignment position.

4. The electrical connector assembly set forth in claim 3 wherein the stop face which faces the leading surface of the female connector when the stabilizer is in the blade alignment position is smaller than the other stop face.

5. An electrical connector assembly comprising:

a mating axis;

a male connector having a terminal blade and a body having a leading face and an alcove, wherein the terminal blade projects forwardly along the mating axis from the leading face;

a female connector constructed and arranged to electrically engage the terminal blade along the mating axis, the female connector having a leading surface which faces the leading face of the body of the male connector;

a blade stabilizer disposed between the leading surface of the female connector and the leading face of the male connector, the blade stabilizer having a blade alignment position when the electrical connector assembly is not mated, a seated position when the connector assembly is mated, and an aperture communicating axially, wherein the terminal blade extends through the aperture when the blade stabilizer is in the blade alignment position and when the stabilizer is in the seated position;

wherein a void of an alcove for protecting the terminal blade exists when the blade stabilizer is in the blade alignment position and is positioned between the leading surface of the female connector and the leading face of the male connector;

wherein the leading face of the body of the male connector is engaged to the blade stabilizer when the blade stabilizer is in the seated position;

a member engaged unitarily to the stabilizer and projecting forwardly along the mating axis from the stabilizer toward the leading surface of the female connector, wherein the member is engaged into the female connector when the leading surface of the female connector is in contact with the stabilizer;

wherein the member is press fitted in the female connector when the leading surface is in contact with the base plate of the stabilizer; and wherein the member has a rounded tab projecting radially with respect to the mating axis and the tab is engaged resiliently to the female connector.

6. The electrical connector assembly set forth in claim 5 comprising:

a shroud projecting axially forward from the leading face of the body of the male connector;

a blind bore radially defined by the shroud; and a body of the female connector disposed within the blind bore when the connector assembly is mated.

7. The electrical connector assembly set forth in claim 6 comprising a base plate of the blade stabilizer disposed perpendicular to the mating axis, wherein the base plate defines the aperture.

8. The electrical connector assembly set forth in claim 5 comprising:

a cam lever engaged pivotally to the male connector; and a cam follower engaged to the female connector, wherein the cam lock lever is engaged to the follower and rotary movement of the lever causes the connectors to move linearly along the mating axis to mate the connectors and move the stabilizer from the blade alignment position to the seated position.

* * * * *